United States Patent [19]

Strait et al.

[11] 3,964,018

[45] June 15, 1976

[54] VEHICLE MONITORING SYSTEM WITH FAULT OVERRIDE

[75] Inventors: Ronald E. Strait; Willard A. Hall, both of Cadillac, Mich.

[73] Assignee: Kysor Industrial Corporation, Cadillac, Mich.

[22] Filed: Oct. 29, 1974

[21] Appl. No.: 518,778

[52] U.S. Cl. ..... 340/52 F; 340/201 R

[51] Int. Cl.[2] ..... G08B 19/00

[58] Field of Search ..... 340/52 F, 53, 183, 184, 340/201; 315/77, 129, 130, 152; 307/10 R, 10 LS, 38, 40; 324/166

[56] References Cited

UNITED STATES PATENTS

| | | | |
|---|---|---|---|
| 3,614,617 | 10/1971 | Blake, Jr. | 324/166 |
| 3,651,454 | 3/1972 | Venema et al. | 340/52 F |
| 3,683,197 | 8/1972 | Ives | 307/10 R |
| 3,723,964 | 3/1973 | Lace | 340/52 F |

*Primary Examiner*—Alvin H. Waring
*Attorney, Agent, or Firm*—Price, Heneveld, Huizenga & Cooper

[57] ABSTRACT

A vehicle monitoring system sequentially monitors a plurality of conditions of vehicle sensors for oil, water, air pressures, temperatures and the like. The system includes sequencing means for sequentially sampling data from each of the plurality of sensors and comparing the sensed data with programmed stored parameter limits representative of fault conditions for each parameter sensed. The system includes means for selecting an individual parameter for continuous display and an override circuit for displaying a nonselected parameter if it reaches a programmed limit. Also, a plurality of operator display select switches are provided and are illuminated such that in the event a detected parameter reaches a stored limit, the select switch associated with that parameter flashes in different colors indicating a warning or an alarm fault condition. In the event the parameter is critical to the operation of the vehicle, a shutdown circuit is provided for terminating the operation of the vehicle by shutting the engine down either immediately or after a predetermined delay.

24 Claims, 6 Drawing Figures

VEHICLE MONITORING SYSTEM WITH FAULT OVERRIDE

BACKGROUND OF THE INVENTION

The present invention relates to a digital vehicle monitoring system.

In vehicle monitoring systems and particularly, systems for use in commercial vehicles such as large trucks, the typical dashboard displays utilize a plurality of analog gauges or indicator lights which, due to the large number, either cannot feasibly be continuously monitored by the operator during vehicle operation or provide an indication only after a failure has occurred and possible engine or vehicle damage has taken place. The use of a plurality of digital displays, one for each condition to be monitored, would not significantly improve such systems.

A few attempts have been made to provide a digital display and/or some form of fault display should one of the vehicle's parameters fall within a danger level for continued operation of the vehicle. U.S. Pat. No. 3,614,617 issued to Bernard S. Blake, Jr. Oct. 19, 1971, U.S. Pat. No. 3,723,964 issued to Melvin A. Lace, Mar. 27, 1973, U.S. Pat. No. 3,665,383 issued to Douglas I. Fales, May 23, 1972, and U.S. Pat. No. 3,711,827 issued to Paul S. Houseman Jan. 16, 1973 represent sytems for providing analog or digital displays in this general field. None of these systems, however, provide a display system which can be employed in the commercial trucking industry to fully satisfy the requirements of vehicle safety or operator convenience.

Thus, there exists a need for a solid-state and preferably digital vehicle monitoring and control system which permits the operator to continuously monitor certain required conditions such as air pressure (for brake systems) and vehicle speed as well as providing a select display for any number of remaining conditions.

Also, there exists a need for a display system which provides an operator-selected display of particular interest to the operator but in the event a nonselected parameter reaches a warning or danger level, the marginal parameter is displayed to override the operator-selected display.

SUMMARY OF THE INVENTION

The system of the present invention satisfies this heretofore unfulfilled need by providing a comprehensive digital monitoring system which sequentially samples and compares data from a plurality of sensors with predetermined limits for each sensed condition. In the event one of the predetermined limits is reached, the system automatically displays that parameter overriding any different operator-selected parameter. In addition, the control system of the present invention includes indicating means to clearly point out the marginal parameter to the operator and indicate the severity of the condition. If dangerous conditions exist, the system automatically shuts the vehicle engine down preventing operation during the existence of the fault condition. Also, the system can include means for correlating related parameters to ascertain whether a required relationship exists for the continued safe operation of the vehicle.

Th comprehensive monitoring and fault control sytem embodying this invention includes means for sequentially scanning a plurality of vehicle parameter sensors and comparing the scanned data with programmed parameter limits at periodic intervals. Selector circuit means permits the operator to select one of a plurality of the sensed parameters for normal display while an override control circuit effects the display of a marginal parameter value (i.e., one which has reached a prestored limit) even if nonselected. The system includes indicator means associated with the selector circuit for indicating the parameter selected or otherwise currently displayed and the severity of the fault should one occur. According to one aspect of the present invention, a unique oil pressure versus engine speed circuit correlates this detected information for providing a fault signal only when their relationship indicates possible harm to the engine.

The present invention, its various features and advantages, can best be understood by referring to the following description thereof together with the drawings in which:

DETAILED DESCRIPTION OF THE PREFERRED EMBODIMENT

Before discussing the circuitry in detail, a brief overview of the system operation will be helpful to a full understanding of the system. Basically, the monitoring system sequentially looks at data from the various analog sensors such as oil temperature, battery volts, water temperature, etc., and the digital sensors during one-half of each cycle of operation which is referred to as scan A. The period within the scan interval in which each of the sensors's data is processed is referred to as a sequence, there being analog sequences for the analog sensors and digital sequences for the digital sensors such as the speedometer and tachometer inputs. The first scan (i.e., scan A) is employed to detect marginal or warning conditions within the system. To achieve this, a storage circuit is programmed with the marginal limits at which the system provides a warning to the operator that one or more of the detected parameters is marginal. During the remaining half cycle of each cycle of operation, each of the sequences is repeated in a scan B mode in which data from the same sensors is again processed and compared with different programmed limits corresponding to dangerous alarm conditions.

The system includes a digital display for speedometer and tachometer outputs and a third digital display common to the remaining parameters which can be individually selected by the operator. In the event the operator has not selected a parameter which becomes either marginal where a warning condition exists or dangerous where an alarm condition exists, the system will automatically preempt the selected display and display the warning or alarm parameter on the common digital display. In addition, the lights associated with the selector switches will flash in different colors or at different frequencies depending upon the severity of the fault and whether or not the displayed fault was operator-selected respectively. In addition, the system includes an automatic control for providing an audible momentary signal for warning conditions and a continuous audible alarm during alarm conditions. This circuit will also automatically shut down the engine operation should an alarm condition exist which is dangerous to the continued operation of the vehicle. Having briefly described the overall function of the system, a detailed description of the overall system is presented in conjunction with the block diagram of FIG. 1 now discussed.

Figure 1:
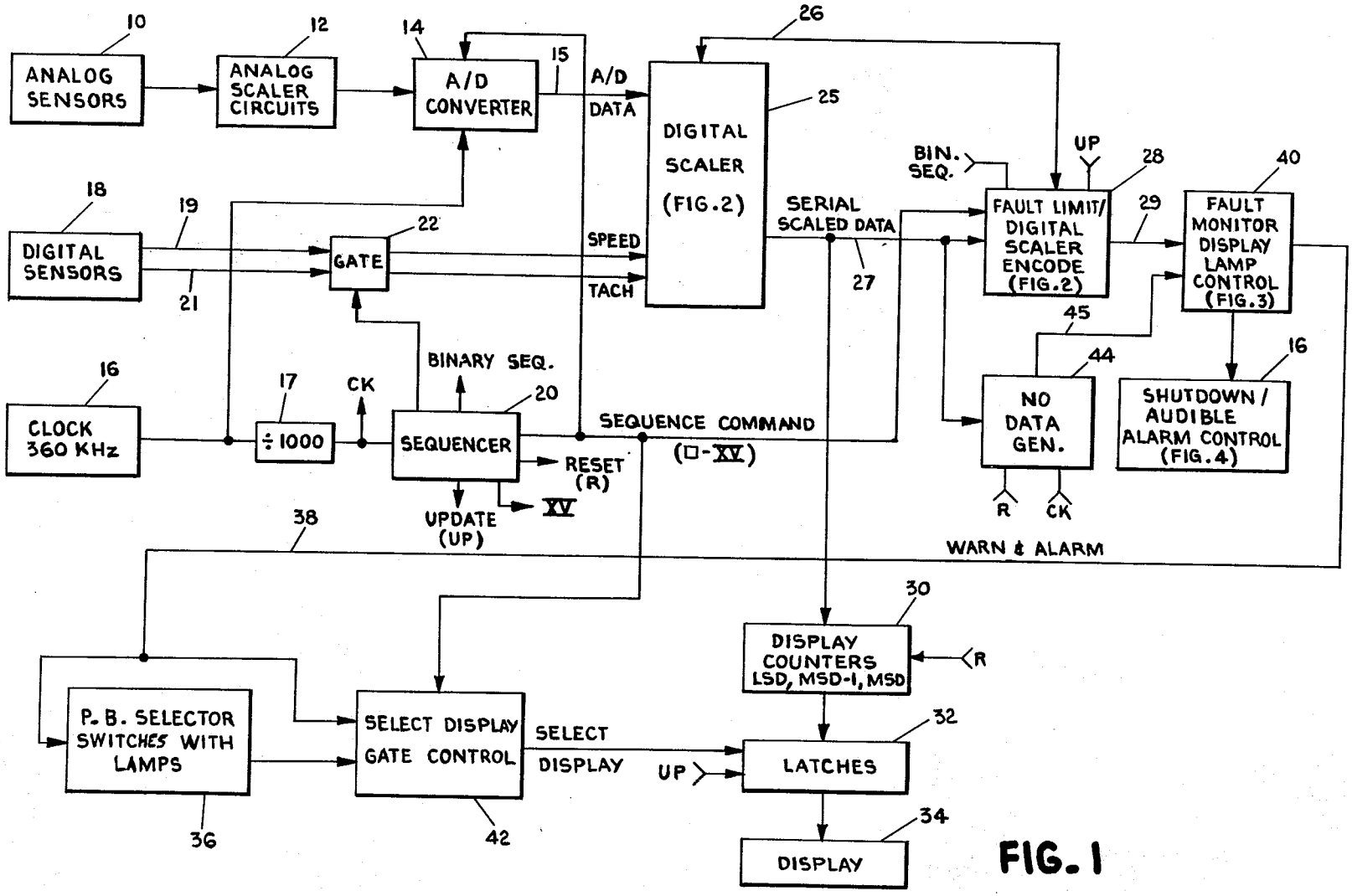
FIG. 1 is an electrical circuit diagram in block form of the system of the present invention.

Referring now to FIG. 1, there is provided a plurality of analog sensors 10 which provide an output voltage corresponding to a condition being sensed. In the preferred embodiment, sensors were provided for water temperature, oil pressure, air pressure, reserve air pressure, exhaust temperature, fuel level and battery voltage. Each of these sensors can be of conventional construction and is a commercially available electrical unit. The varying output signals of the analog sensors 10 are applied to a plurality of analog scaler circuits 12, each of which comprises amplifier circuits with selected gain and feedback characteristics to provide a 0–10 volt DC output for the full scale range of input signals (including the warning and alarm levels) from each associated analog sensor. Circuit 12 thus provides for each analog sensor an output signal applied to a dual ramp A/D converter 14 which is a conventional circuit commercially available in the form of an integrated circut module. A/D converter 14 receives pulses from clock pulse generator 16 and sequence command signals from sequencer circuit 20 to gate circuit 14 for converting analog diata frm each of the analog sensors to digital data during the sequence associated with the sensor and as shown by waveform 4 of FIG. 5. The output from the A/D converter 14 is a sequence of a plurality of clock pulses where the number of pulses in each sequence corresponds to the parameter value detected by one of the analog sensors within its data sequence. The output conductor 15 of the A/D converter is identified as A/D data.

In addition to the analog sensors 10, digital sensors 18 are provided. These include pulse generating means for the vehicle speed as well as the pulse generating means or tachometer for the engine rpm's. Such pulse generating speed and tachometer circuits are conventional and commercially available and provide outputs in the preferred embodiment on conductors 19 and 21, respectively, to a triggered gate circuit 22. Gate 22 is coupled to sequencer 20 and receives a sequence command therefrom which actuates the gate to pass pulses from conductors 19 and 21 to a digital scaler circuit 25 only during the respective digital sequences of each scanning cycle of operation of the system.

Sequencer 20 provides the sequence commands for the system and receives 360 Hz clock pulses from dividing circuit 17 coupled to the clock generator 16. The clock pulses 1 are shown in the timing diagram of FIG. 5. Sequencer 20 includes a binary counter such as a commercially available integrated circuit type 7493 which receives pulses 1 and provides a time varying binary code output. This code is applied to a binary-to-serial converter (such as a commercially available type 74154 integrated circuit) which responds to the binary code to provide a plurality of sequence commands identifying the initiation of each of the analog and digital sequences of operation of the system and which is represented by commands □-XV in FIG. 1. The sequencer also provides output signals 2 which are the update command shown as the second waveform in FIG. 5 and the reset pulses (R) shown as waveform 3 in FIG. 5.

Figure 5:
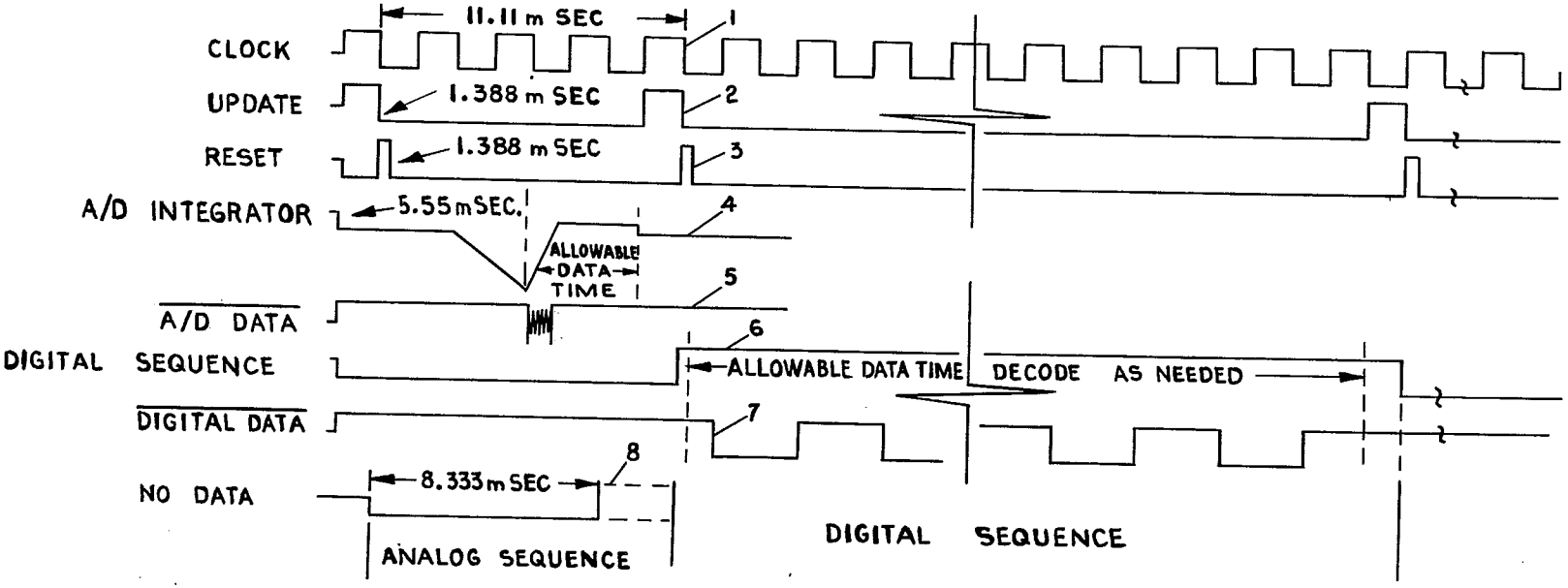
FIG. 5 is a waveform diagram showing the electrical signals defining the timing sequence for the circuit of FIG. 1.

During each analog sequence having a period of approximately 11 msec. as shown in FIG. 5, the A/D converter will apply a burst of 360 KHz pulses (as shown by waveform 5 in FIG. 5) to scaler circuit 25. Similarly, the pulses from the digital sensors will, during one of the digital sequences established by sequencer 20, provide a plurality of pulses as shown by waveform 7 corresponding to digital data which is also applied to the digital scaler 25.

Figure 2:
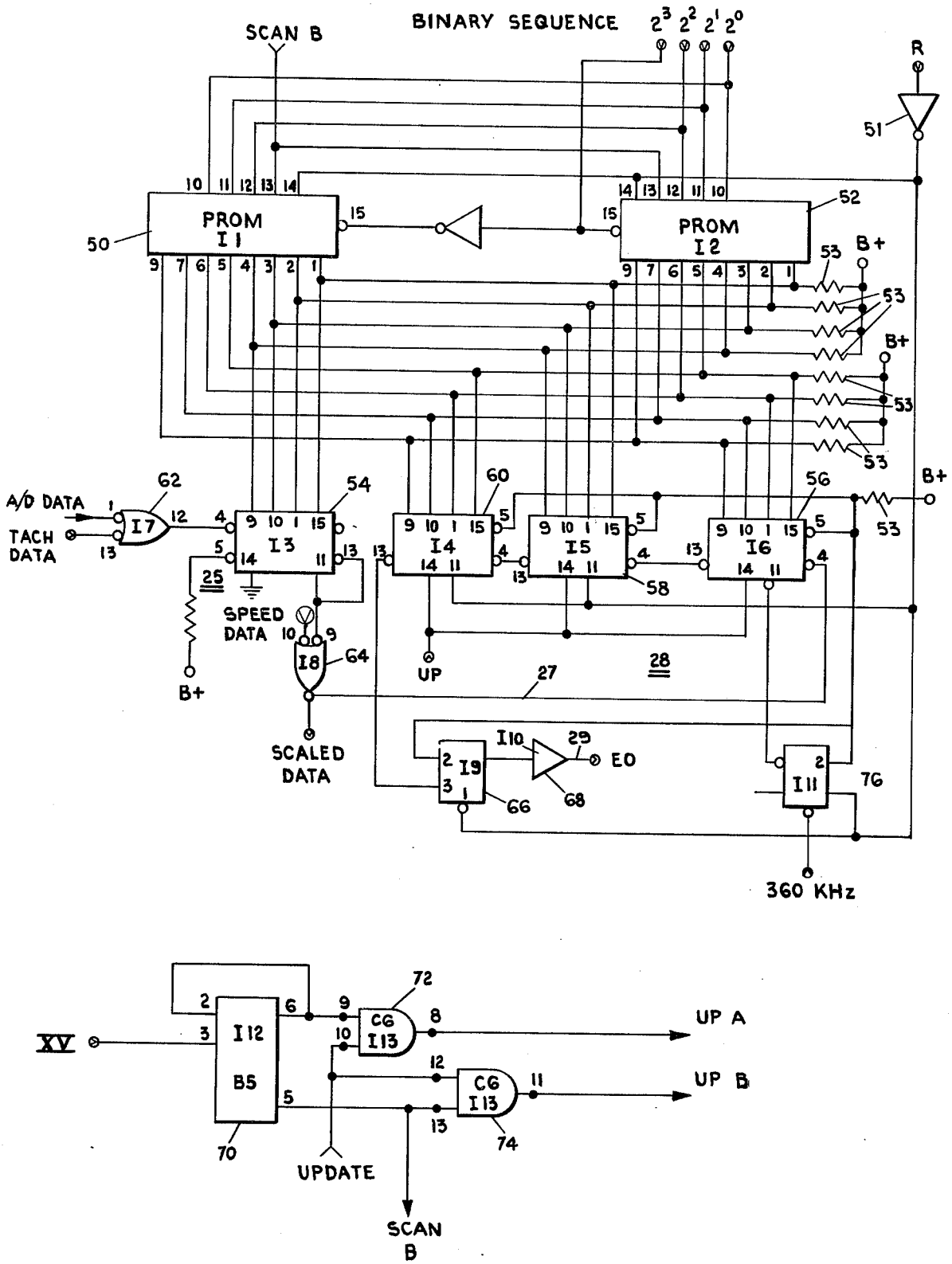
FIG. 2 is an electrical circuit diagram in schematic form of the fault limit digital scaler encode circuits shown in FIG. 1.

The digital scaler circuit 25 shown in detail in FIG. 2 and in block form in FIG. 1 receives the clock pulse bursts corresponding to the 360 KHz data from converter 14 and the significantly lower frequency pulses from gate 22 corresponding to digital data and depending upon the sequence on which the system is operating, will divide the pulses received during a sequence to provide a usable number of pulses permitting a meaningful output for the digital display. In the preferred embodiment, 0–1000 pulses applied to the input of the scaler circuit 25 represents the full range for the various sensors. For oil pressure, for example, full scale may be 100 lbs. corresponding to 1000 360 KHz pulses but 100 counts for the display. Thus, for oil pressure, circuit 25 would divide by ten the A/D data during the oil pressure sequence to provide the desired display output. The scaler circut, therefore, permits the use of a single digital display with a different range of outputs for a preselected number of input pulses representing full scale for all of the sensors. Scaler circuit 25 is programmed to selectively scale the input data during each sequence by means of signals applied to the scaler by conductor 26 intercoupled to the fault limit/digital scaler encode circuit 28 shown in FIG. 1 and in detail in FIG. 2. A detailed discussion of the FIG. 2 circuits will be provided after the continued discussion of the block diagram of FIG. 1.

The output of the digital scaler circuit 25, therefore, is a series of pulses during each analog and digital sequence which is repeated for a scan A corresponding to warning condition detection and scan B corresponding to alarm condition detection. This serial data is applied to a plurality of display counters 30 which are of conventional construction and include least significant (LSD), most significant (MSD) and intermediate significant (MSD-1) counters and which are reset at the beginning of each sequence by a reset pulse from sequencer 20. The output of display counter 30 is coupled to a conventional latch circuit 32 which is updated by an update pulse from sequencer 20 at the end of a select sequence. The output of latches 32 drive the common digital display included in display unit 34. Display unit 34 includes three conventional digital displays, one of which is the operator-selected display and common to the analog sensors while a separate display is associated with each of the tachometer and speed indicating sensors.

In order to select any number of the variety of analog sensor conditions such as oil pressure, water temperature, etc., a plurality of push button selector switches are provided as shown by the block diagram circuit 36. The switches include lamps with white and red lenses for use as warning and alarm indicators and which are powered by conductors 38 coupled to the fault monitor lamp display control circuit 40 shown in detail in FIG. 3. The push button selector switches are also coupled to the select display gate control 42. Circuit 42 includes a plurality of latches which, when a momentarily actuated push button switch is pushed by the operator to select a particular display, the latch associated with the operator push button switch is latched. Circuit 42 also receives sequence commands □-XV from sequencer 20 and will actuate circuit 32 to display only the selected display which occurs on the coincident application of the sequence command and the latched output of the latch associated with the parameter selected by the operator to circut 32. Thus, during normal operation, the system will monitor and display the conditions selected by the operator who has momentarily actuated the push button corresponding to the vehicle parameter desired.

It is noted here that the signals on output conductor 27 of the digital scaler provide continuous and repeated monitoring each of the sensors of the system wheter or not that particular sensor output is selected to be displayed. This continuous monitored information is applied to the circuit 28 and the no data generator 44. In the event a sensor fails and thus provides no output, if the sensor is a low limit warning type (such as oil pressure), the normal low limit warning provisions of the monitoring system will indicate a warning and possibly a shutdown condition.

In the event the sensor is a high limit type (water temperature), however, and no data is received, the normal warning circutry will not be actuated. To accommodate this particular condition, the no data generator 44 is provided which receives reset and clock pulses from sequencer 20 and comprises a counter which provides an output pulse shown as waveform 8 in FIG. 5 only in the event that during any sequence, no data is received after 8.3 msec. or approximately two thirds of the sequence.

Typically, if the sensors are operative, data will have been received during this time and will disable the counter and prevent the outputting of a no data pulse on conductor 45 of circuit 44. A no data pulse, however, is applied to circuit 40 to indicate an alarm condition should the sensor fail. Circuit 28 provides an event occurred signal on conductor 29 which corresponds to normal operation, or upper or lower warning and alarm conditions, which signals actuate circuit 40 to in turn provide a flasing lamp display and audible alarm as described in detail below.

Figure 4:
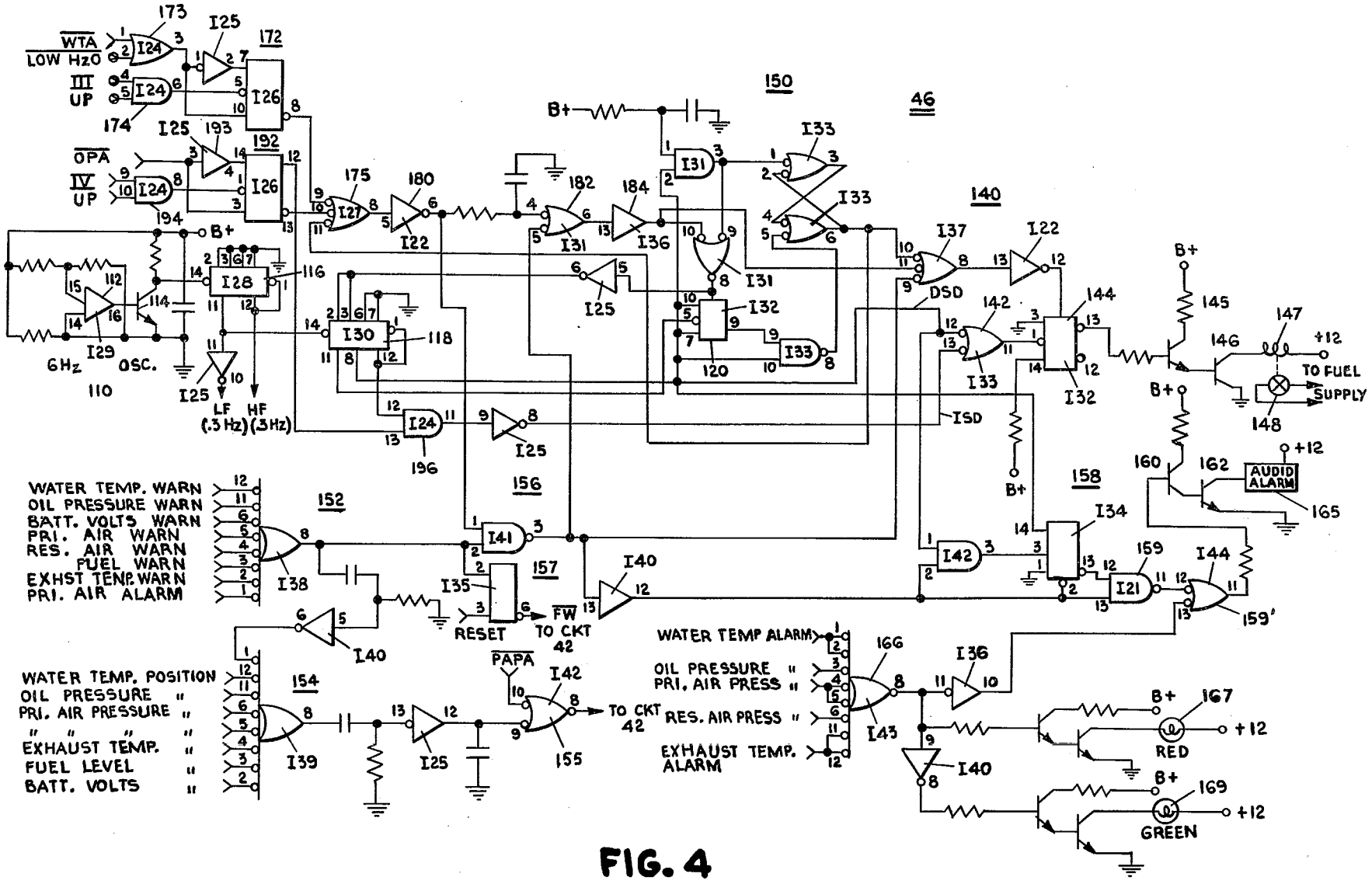
FIG. 4 is an electrical circuit diagram in schematic form of the shutdown/audible alarm control circuit shown in FIG. 1.

The output of circuit 40 is also coupled to a shutdown audible alarm control circuit 46 shown in detail in FIG. 4. Circuit 46 will respond to a warning signal to provide a momentary (15 sec.) audible alarm to the vehicle operator and respond to alarm signals to automatically shut down the vehicle operation either immediately or after a 15 sec. delay as well as provide a continuous audible alarm. Having briefly described the overall system, a detailed description of circuits 25, 28, 40 and 46 follows. In the drawings, the commercially available integrated circuits include their standard terminal numbers to clearly show their interconnection with the remaining circuit elements.

The circuitry of FIG. 2 provides the stored warning and alarm limit signals which are compared or otherwise correlated with the detected data signals during the scan A and scan B portions of each cycle respectively. The storage means comprises programmable read-only memories (PROMs) 50 and 52 which are programmed with the desired warning and alarm limits and which are addressed by the 4-bit binary sequence code (□-XV) from the sequencer circuit such that during the first portion of each sequence of scan A or scan B, a predetermined binary number (word) will be transferred from the PROMs into series coupled counters 56, 58 and 60. In order to provide the relatively large capacity of 15 sequences, a pair of PROMs is employed to parallel load the limits into the counters 56–60. During the remaining portion of each sequence (shown in FIG. 5 as allowable data time), the up-down digital counters 56–60 are decremented by either scaled A/D data, tach pulses or speedometer pulses coupled to input terminal 4 of counter 56 through gate 64 as seen in FIG. 2. In the event a limit is exceeded, the counters will decrement to zero and output terminal 13 from counter 60 will actuate a latch 66 coupled to inverter 68 to provide an "event occurred" signal identified as signal EO at terminal 29 of circuit 28. The counters are reset by a reset pulse from inverter 51 at the beginning of each sequence.

PROMs 50 and 52 additionally provide, when actuated by a binary sequence code, a program code for the digital scaler circuit 25. circuit 25 includes a programmable counter 54 which will selectively divide the A/D data signals or tach signals as required for the desired output display as noted above. The speedometer signal is the lowest frequency signal and is passed through gate 64 and not divided. The scaled data is then applied to the counters 56, 58 and 60 by conductor 27. Thus, th PROMs 50 and 52 are employed for storing limit signals which are selectively loaded into counters 56–60 during each sequence and program the digital scaler counter 54 for proper scaling of the data of a given sequence. To provide information which addresses the PROMs for the scan A or scan B limits, a scan B signal is developed by the flip-flop circuit 70 having an input terminal coupled to the sequencer 20 to receive the command pulse or sequence XV.

The outputs of flip-flop 70 are applied to AND gates 72 and 74 and the periodic update pulse is applied to AND gate 74 and to the remaining input terminal of AND gate 72. The output of gate 72 provides scan A update pulses to circuit 40 while the output of AND gate 74 provides the update pulse B for circuit 40 as described in greater detail below. The remaining input terminal of gate 74 corresponds to the scan B signal which occurs at the end of scan A when circuit 70 receives the sequence command XV.

Thus, it is seen that the PROMs 50 and 52 are addressed by a combination of binary sequence signals, scan B signals and the signals from amplifier 51. The operation of the PROMs can best be explained by way of example. During sequences □-VII, PROM 52 is addressed while PROM 50 is addressed during sequences VIII–XV. For the oil pressure warning signal, for example, the binary words 7 and 23 for the PROM 52 are the addresses associated with the programmed oil pressure warn limits. During the oil pressure sequence (sequence VII), scan A and the occurence of a logic "1" input on amplifier 51, the stored information corresponding to the binary address word input 7 is called up and loaded into counters 60 and 58. Also during sequence VII, scan A and the occurrence of a logic "0" input on amplifier 51, the stored limit for binary address word 23 is called up from PROM 52 and counter 56 loads the binary information stored at this address during the first clock pulse period after the receipt of a reset pulse.

Thus, counters I4, I5 and I6 are incremented to the count corresponding to the preprogrammed limit for the oil pressure warning system and counter 54 remains coded from PROM 52 to divide the incoming data by the proper scaling factor corresponding to the desired sequence. As data is received, counters 56, 58 and 60 are decremented by the incoming data until and if the preprogrammed limit is reached, or until the end of the particular sequence.

Similarly, different addresses are employed to call up the stored limits for the oil pressure alarm during the scan B period. Similarly also, each of the sensed conditions of the system includes a predetermined assigned portion of time within each of the sequences and scan intervals for alarm and warning conditions, respectively, with the PROMs being addressed to call up and load the associated limits into the counters for comparing, in effect, the associated incoming data with its limits. A plurality of resistors 53 are coupled from B+ to the output terminals of the PROMs and to pins 5 of counters 56–60. A flip-flop 76 provides a data loading command from its output terminal to terminal 11 of counter 56 thereof in response to the first system clock pulse after receipt of a reset pulse. Flip-flop circuit 66 receives a pulse from terminal 13 of counter 60 to provide an EO pulse when scaled data exceeds a programmed limit.

Figure 3:
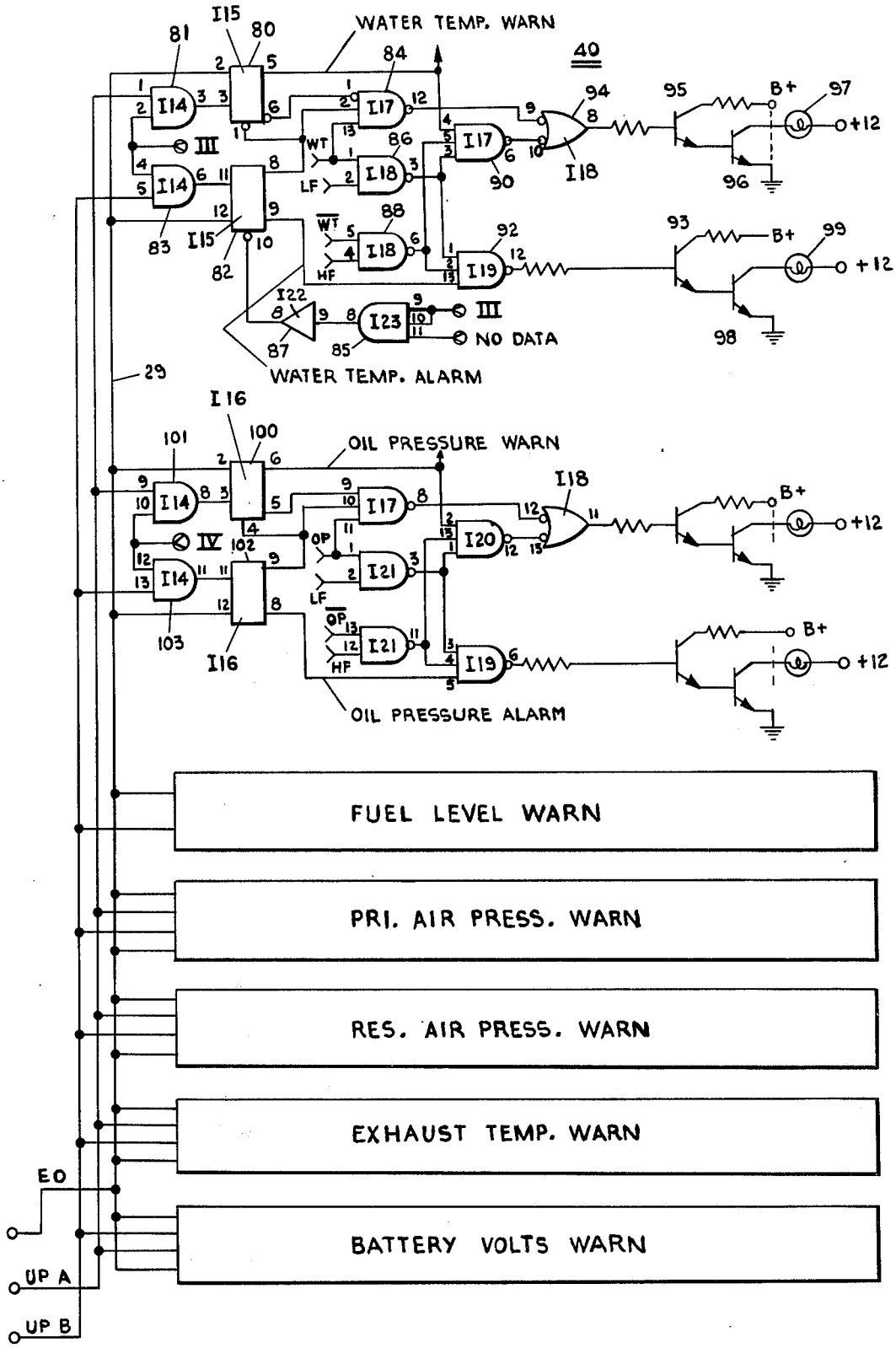
FIG. 3 is an electrical circuit diagram in schematic and block form of a portion of the fault monitor display lamp control circuit shown in FIG. 1.

The event occurred (EO) signal from circuit 28 is applied to the logic circuits of the fault monitor display lamp control circuit 40 shown in detail in FIG. 3. There are three types of faults being monitored, the high limit in which the stored fault limit has been reached either by a warning or by an alarm condition, a low level limit in which the program fault limit has not been reached and the no data condition where the sensor itself is not supplying data to the system. Associated with each of the sensors is a logic circuit which responds to the event occurred signal and the no data signal to provide either a warning or an alarm condition if these faults occur. Since many of the circuits are duplicative, in FIG. 3 only the water temperature and oil pressure logic is shown. The remaining circuits are virtualy identical and thus need not be described in detail.

The event occurred conductor 29 is coupled to input terminals 2 and 12, respectively, of a pair of flip-flops 80 and 82 associated with the water temperature logic and 100 and 102 associated with the oil pressure logic. The clock inputs of the flip-flops are coupled to the output of a pair of AND gates 81 and 83 and 101 and 103 respectively. These gates "and" the signals from update A and update B, respectively, with the particular sequence command associated with the sensor being monitored. Thus, sequence command III is applied to input terminals 2 and 4 of gates 81 and 83, respectively, while the oil pressure sequence command IV is applied to terminals 10 and 12 of AND gates 101 and 103 respectively. The outputs of flip-flops 80 and 82 are applied to the first two inputs of a three input NAND gate 84 having a third input identified as WT in the drawing. Terminal WT is coupled to the push button selector latch for water temperature which applies a logic "1" signal to this input when the water temperature is selected by the operator. Terminal WT is also coupled to the first input terminal of a NAND gate 86. The invert of the signal on terminal WT (i.e., $\overline{WT}$) is applied to one input terminal of NAND gate 88 having its remaining terminal coupled to the high frequency oscillator output HF (FIG. 4) while the remaining input terminal of NAND gate 86 is coupled to the low frequency output terminal LF of FIG. 4. The sequence command and no data signals are summed by gate 85, inverted by inverter 87 and applied to flip-flop 82.

The output terminals of NAND gates 86 and 88 are applied to two terminals of the three input NAND gates 90 and 92 while the remaining input of gate 90 is coupled to the water temperature warn signal at output terminal 5 of flip-flop 80 and the remaining terminal of gate 92 is coupled to the water temperature alarm signal on output pin 9 of flip-flop 82. The output of gate 90 is applied to one input of NAND gate 94 having its remaining input coupled to the output of gate 84. The output of NAND gate 94 is coupled to a driver amplifier comprising an NPN transistor 95 output which in turn is coupled to a solid-state switch comprising an NPN transistor 96. The collector circuit of transistor 96 is coupled in series with a white indicator lamp 97 associated with the water temperature push button selector switch 36 of FIG. 1 as indicated by the dotted lines in FIG. 3.

The output of gate 92 is coupled to a driver amplifier comprising NPN transistor 93 which in turn actuates a solid-state switch which comprises an NPN transistor 98. The collector circuit of transistor 98 is coupled in series with a red lamp 99 associated with the same switch as lamp 97. Having described the structure of the water temperature logic of circuit 40, a brief description of its operation follows.

During scan A, sequence III, gate 81 will be actuated by the coincidence of an update pulse A and command pulse III. The output from gate 81 in turn actuates flip-flop circuit 80 to respond to the condition of the event occurred line 27. If the water temperature is normal, the output of the water temperature warning latch 80, pin 5 will be a logic "O" as will the output pin 9 of the water temperature alarm latch 82. Thus, inputs 1 and 2 of gate 84 will be high and if water temperature has been selected by the operator, input 13 likewise will be high and output 12 will be low. With a low input applied to terminal 9 of gate 94, the output will be high turning transistor 95 and 96 on and lighting the white lamp 97 in a steady mode. At the same time, since the water temperature has been operator-selected, the digital display 34 associated with the analog sensors will continuously display the water temperature. During this condition, the output at terminal 9 of latch 82 will be low and is applied to input terminal 13 of gate 92 thereby causing a low output at terminal 12 which applied to transistor 93, renders it nonconductive in turn maintaining red lamp 99 off.

In the event the water temperature reaches the warning level (for example, 200°) during scan A, the digital A/D data applied to input terminal 1 of gate 62 and thence to the up-down counters via line 27 of FIG. 2 will equal or exceed the count entered into the counters from the PROMs causing an event occurred signal on conductor 29 when flip-flop 80 is clocked by scan A, sequence III, update A. This changes the state of flip-flop 80 to apply a low level signal to pin 1 of gate 84. With any low applied to this gate, pin 9 of gate 94 becomes high as does input 4 to gate 90. Input 3 of gate 90 is coupled to the output of gate 86 which applies the sum of the WT and LF signals to gate 90. When the water temperature is selected, the LF signal thus will be applied to input 3 of gate 90 and when combined with the water temperature warn signal, will actuate gate 94 to periodically provide low frequency positive pulses to flash lamp 97 at approximately 0.3 Hz.

In the event, however, water temperature is not selected and a warning temperature is reached, input terminal 1 of gate 86 is low whereas input terminal 5 of gate 88 is high causing the multiplexing of the HF pulses applied to pin 4 of gate 88 with the remaining inputs of gate 90 to flash bulb 97 at a high frequency. Thus, in the event a water temperature warning level is reached, lamp 97 will either flash at a low frequency if previously selected by the operator or at a higher frequency (3 Hz) in the event the display is not selected.

In the event the water temperature rises, for example, to 210° where the stored alarm limit is reached, the same multiplexing effect of either low frequency or high frequency flashing occurs with respect to gate 92 causing the red lamp 99 to flash at a low or a high frequency depending upon whether the water temperature is operator-selected or not respectively. If, however, the alarm condition exists, it will occur during scan B, thus during the occurrence of an update B signal which actuates gate 83 while gate 81 is not actuated.

In the event a sensor is inoperative and, therefore, no data is received, the no data signal is multiplexed with the command III signal in gate 85 which serves to trigger latch 82 indicating a water temperature alarm signal. It is seen that by employing gates 81, 83 and 85, therefore, these gates will actuate either the warn latch 80 or alarm latch 82 causing the flashing illumination of lamps 97 or 99 respectively.

With latch 82 set and causing an alarm signal, it is noted that the signal at output pin 8 thereof prevents the indication of a further warning signal during an alarm condition. This is desirable since only an alarm signal need be displayed under an alarm fault even though the warning limit has also been exceeded. It is noted here that the water temperature warning signal on output 5 of latch 80 and the water temperature signal on output pin 9 of latch 82 are also applied to the shutdown audible alarm control circuit 46 which is discussed in detail below.

The water temperature logic represents a typical high limit logic and the exhaust and the optional oil temperature limit logics are of the same construction and operation. There are several low limits including oil pressure fuel level, primary and reserve air and battery volts which are typical. The oil pressure logic circuit is shown in detail in FIG. 3 and also includes input gates 101 and 103 which serve to synchronize the application of an event occurred signal on the warning and alarm latches 100 and 102 with the occurrence of scan A or scan B and update and the sequence IV. The remaining gates are identical in function to those shown with respect to the water temperature logic and need not be discussed in detail. The only significant difference is that with the low limit, it is normal to receive an event occurred signal from the oil pressure sensor since the lower limit is typically exceeded. In such case, it is the absence of the event occurred signal which causes the actuation of the latches 100 and 102 to cause the low or high frequency flashing of the white or red lamps associated therewith respectively. To invert this logic, different outputs of the D-type flip-flops 100, 102 are employed causing this inverted result from the water temperature logic system.

In order to provide identical logic systems and, therefore, permit large scale integration of all of the logic circuitry shown in FIG. 3, steering gates can be employed to provide the inverted input for the low or high (or both) limits required by the different sensors.

In the oil pressure system, the alarm level may be at, for example, 5 lbs. which will nearly always be exceeded unless the oil pump fails while the warning level may be at 15 lbs. which also normally is exceeded during engine operation. Accordingly, the event occurred pulse will normally be received by the circuit and only when the oil pressure is below 5 or 15 lbs. will the event occurred signal not occur during scan A or scan B.

Similarly, each of the analog sensors includes an associated logic circuit for actuating the flashing lamps associated with the selector switches. Each of the logic circuits generates either a warning signal or an alarm signal when such fault conditions exist, which signals are applied to the shutdown audible alarm control circuit 46 shown in detail in FIG. 4.

Circuit 46 shown in FIG. 4 provides a variety of functions to the digital display system. First, at an initial turn-on, there is provided a 30 sec. delay sequence which inhibits the audio alarm and shutdown modes of operation since during this period, erroneous fault conditions may otherwise be displayed during warm-up. Secondly, if any warning occurs, a momentary (i.e., 15 sec.) audio alarm occurs. Thirdly, for a zero oil pressure or if desired, other conditions of immediate possible harm to the engine, the system will immediately shut down the vehicle's engine. Fourth, in the event other alarm conditions exist, the system provides a 15 sec. delayed shutdown and a continuous audible alarm.

The timing of these functions is provided by a timer circuit common to the remaining circuits of FIG. 4 and the latches associated with each of the systems. The timer circuit consists of a 6 Hz oscillator 110 which includes a PUT 112 which drives transistor 114 at 6 Hz. The 6 Hz signal is applied to the input terminal 14 of a frequency divider 116. Circuit 116 provides a 0.3 Hz output signal employed as the LF signal and coupled to the FIG. 3 circuit and a HF signal of 3 Hz pulses which are also applied to the circuit of FIG. 3 as noted above.

The 0.3 Hz signals are applied to a divide-by-10 counter 118 which provides an output pulse every 15 sec. at an output terminal 11 thereof. This 15 sec. signal is applied to a divide-by-two counter 120 and to pin 12 of NAND gate 142 of a shutdown latch 140. Shutdown latch 140 including flip-flop 144 generates a positive output signal at pin 13 of circuit 144 thereby actuating NPN transistors 145 and 146 to actuate solenoid 147 during the normal mode. Solenoid 147 opens valve 148 associated therewith and in series with the vehicle fuel system to disable the engine for shutdown. This occurs when either of the inputs 12 or 13 of NAND gate 142 are low. Input 12 is the delayed shutdown input for gate 142 while input 13 is the immediate shutdown.

As noted earlier, during initial turn-on, it is desired to prevent shutdown of the system due to false warnings. Accordingly, the 30 sec. output pulse from divider 120 is applied to the turn-on latch circuit 150 which provides a signal to the reset terminal of latch 144 to prevent the deactuation of transistors 145 and 146 during the first 30 seconds regardless of any detected warning or alarm condition. After the 30 sec. period, the signal applied to the reset terminal is removed and the system will function normally. In order to fully understand the operation of the system, a brief description of the operation during a warning and subsequently, an alarm of a noncritical nature (i.e., no shutdown required) will be discussed followed by a discussion of the shutdown modes of operation.

If, for example, the exhaust temperature warning occurs, the warning signal from circuit 40 is applied to a multiple input NAND gate 152 causing the output of pin 8 to go high which is capacitively coupled to pin 1 of multiple input NAND gate 154. The remaining inputs of gate 154 are coupled to the push button switches which normally select the operator-selected vehicle parameter for display. The output of gate 154 is coupled to selector circuit 42. During a warning mode, however, the low pulse at input terminal 1 will clear the selected gate and the warning signal applied to the select display gate circuit via conductor 38 (FIG. 1) will assure only the parameter at the warning level will be displayed. During the warning mode, the high output of terminal 8 of gate 152 is also applied through NAND gate 156 and to latch 157 which also is coupled to the select display circuit 42 which responds to lock out all but the first warning (FW) signal received.

NAND gate 156 also receives a signal as described below at input terminal 1 for actuating the shutdown latch. During warning, the high output of gate 156 is applied to the audio alarm latch 158 which also receives a 15 sec. alarm actuating pulse from frequency divider 118 such that NAND gate 159' will be actuated for 15 sec. to actuate transistors 160 and 162 which in turn actuate a suitable audio alarm such as a buzzer unit 165 for a period of 15 sec.

Thus, in the event only a warning occurs, a 15 sec. audio alarm occurs and the digital display automatically is switched to display the system parameter within the warning limits.

During an alarm condition, the alarm signal from circuit 40 is applied to NAND gate 159' from gate 166 to cause the continued actuation of audio alarm 165. The output at pin 8 of gate 166 also drives a separate red lamp 167 indicating a system shutdown condition while disabling the normally on lamp 169 which is a green light thus indicating either normal or abnormal conditions exist.

Once an alarm occurs, as noted above, the audio alarm is continuously actuated and the red light 167 comes on continuously as well as the flashing red light of the select display lamp circuit as noted above with reference to FIG. 3. If, however, the alarm is either the type of alarm which would require immediate or delayed shutdown, the shutdown latch 140 is either actuated immediately or on a delayed basis in the following manner.

In the circuitry of FIG. 4, either a low water level or water temperature alarm will actuate a delayed shutdown latch 172. The low water level is a separate sensor switch applied to input 2 of AND gate 173 which also receives a water temperature alarm at input 1. To synchronize the receipt of these signals with the proper sequence, a sequence and update signal is summed by AND gate 174 which is coupled to terminal 5 of latch 172. The output of latch 172 is applied to NAND gate 175 which initiates the actuation of the common timer circuit 118.

In the event immediate shutdown is required, as for example, when the oil pressure drops to zero, the immediate shutdown latch circuit 192 is actuated by the oil pressue alarm applied to terminal 14 thereof through inverter 193. Gate 194 synchronizes the operation of this latch with sequence IV associated with the oil pressure sensor and applies a signal to gate 175 and also to AND gate 196. AND gate 196 terminal 12 clocks high within 1.5 sec. and provides a pulse to terminal 13 of gate 142 which causes the immediate actuation of latch 144 and the opening of control 148 when a signal is applied to terminal 13 of gate 196. This causes immediate shutdown when the oil pressure alarm signal occurs.

The remaining circuitry in FIG. 4 is the provision of the PAPA signal input to terminal 10 of gate 155, which input corresponds to the primary air pressure alarm which causes this alarm to preempt all other alarms and cause a display of the primary air pressure when it drops below the alarm level of 60 lbs. in the preferred embodiment.

In some installations, the oil pressure will vary markedly depending upon the engine rpm. For example, in some engines, at very low or idle engine speeds, the oil pressure drops to nearly 0 lbs. Normally, this would be detected as an alarm condition causing the immediate shutdown of the engine. To prevent this from occuring, a correlation circuit for providing an oil pressure alarm only when the oil pressure falls below a predetermined value for a given rpm can be provided and is shown in FIG. 6.

Figure 6:
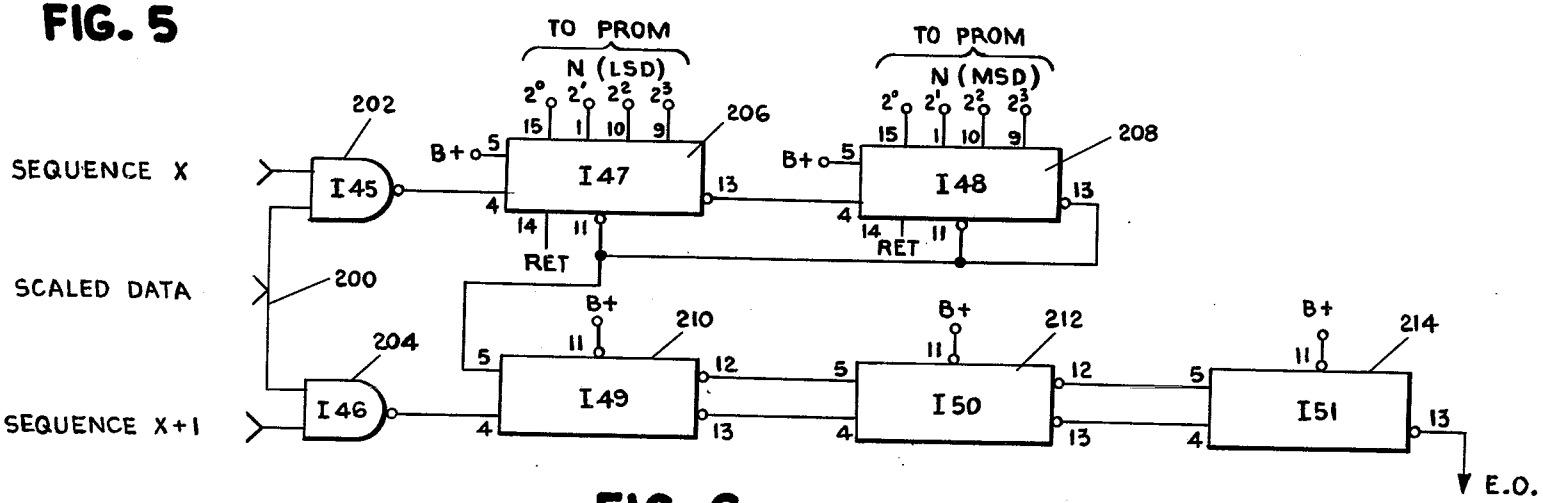
FIG. 6 is an electrical circuit diagram in schematic form of the oil pressure versus engine speed correlating circuit.

Initially, it is noted that the circuit of FIG. 6 can be employed for correlating any two successive sequences of information to provide a warning signal only when a predetermined relationship exists between the signals. In the preferred embodiment, this sequence is employed for comparing oil pressure versus engine rpm's.

In the FIG. 6 circuit, scaled data from conductor 27 of FIG. 1 is inputted on conductor 200 coupled to one input of a first NAND gate 202 and one input of a second NAND gate 204. A sequence command is applied to the remaining inputs of gates 202 and 204 with the unnumbered sequence $\chi$ applied to gate 202 and the successive sequence $\chi+1$ applied to the remaining input terminal of gate 204. During sequence $\chi$, the scaled data, for example, of 100 pulses representing 1000 engine's rpm, is applied to the input terminal 4 of a first up-down counter 206 whose output terminal 13 is coupled to input terminal 4 of a serially coupled second up-down counter 208. Counters 206 and 208 are programmed to divide by any desired scale factor (N) by a 4-bit binary code applied to each of the dividers from one of the PROMs shown in FIG. 2.

Thus, during sequence $\chi$, the word output from one of the PROMs will program counter 206 to provide the least significant digit of the scaled data divided by the scaling factor N while counter 208 is programmed by the PROM word to provide the most significant digit. For example, N may equal 4 in the preferred embodiment such that during sequence $\chi$, the 100 count fed into counters 206 and 208 is divided by 4 with the resultant number 25 serially loaded into the additional serially coupled up-down counters 210, 212 and 214.

At the end of sequence $\chi$, gate 202 is rendered inoperative and gate 204 pulsed by sequence command $\chi+1$ passes the scaled data corresponding to the monitored oil pressures, for example, which may be 25 lbs. and, therefore, 25 digital pulses are passed by gate 204 to the series coupled counters 210, 212, 214 to decrement the stored number 25 (its value depending upon the engine rpm and the scaling factor). If the number of stored counts is exceeded, counter 214 outputs a negative going pulse at terminal 13 indicating an event has occurred. In this example, where it is desired to indicate a warning should the oil pressure fall below 0.5 lbs. at a 1000 engine rpm's, if an event occurs there would be no warning signal but if an event did not occur a warning signal would be generated. Accordingly, the output 13 of counter 214 is applied to a low limit logic circuit of the type employed for the oil pressure warning alarm shown in FIG. 3.

Thus, for the example given with reference to FIG. 6, a warning signal will be generated if the oil pressure is equal to or less than 25 lbs. at 1000 engine rpm's. The sequences $\chi$ and $\chi+1$ will correspond to two successive sequences of scan A. During scan B, the PROM will be programmed with a different scaling factor to, for example, provide a warning signal should the oil pressure fall below a predetermined level for a selectable ratio of the engine rpm divided by the scale factor which can be different. Thus, the scaling factor is programmable for warning and alarm conditions to provide an event occurred signal applied to the circuitry of FIG. 3 as required for a particular application.

In the preferred embodiment, the following commercially available integrated circuits were employed as shown in the drawings:

| Circuit Identification | Type | Circuit Identification | Type |
|---|---|---|---|
| I1 | 8223 | I27 | 7410 |
| I2 | " | I28 | 7490 |
| I3 | 74192 | I29 | 2N6027 |
| I4 | " | I30 | 7490 |
| I5 | " | I31 | 7408 |
| I6 | " | I32 | 7473 |
| I7 | 7400 | I33 | 7400 |
| I8 | " | I34 | 7473 |
| I9 | 7474 | I35 | 7474 |
| I10 | 7404 | I36 | 7404 |
| I11 | 7474 | I37 | 7410 |
| I12 | " | I38 | 7430 |
| I13 | 7408 | I39 | " |
| I14 | " | I40 | 7404 |
| I15 | 7474 | I41 | 7400 |
| I16 | " | I42 | 7408 |
| I17 | 7410 | I43 | " |
| I18 | 7400 | I44 | 7400 |
| I19 | 7410 | I45 | " |
| I20 | " | I46 | " |
| I21 | 7400 | I47 | 74192 |
| I22 | 7404 | I48 | " |
| I23 | 7411 | I49 | " |
| I24 | 7408 | I50 | " |
| I25 | 7404 | I51 | " |
| I26 | 7473 | | |

It will become apparent to those skilled in the art that various modifications to the present invention can be made without departing from the spirit or scope of the invention as defined by the appended claims.

The embodiments of the invention in which an exclusive property or privilege is claimed are defined as follows.

1. A monitor system for vehicle parameters comprising:

means for providing continuous parameter value information for a plurality of vehicle parameters;

sequencing means for providing a series of sequence commands defining a data sequence for each parameter during a scan interval;

scaler circuit means coupled to said providing means and to said sequencing means for providing serial scaled data during each scan interval;

means for storing preselected parameter limits;

correlating means coupled to said storage means and to said scaler circuit means for correlating data received from said scaler circuit means with corresponding parameter limits from said storage means and for providing an event occurred output signal if data from said scaler circuit means for a parameter reaches a predetermined stored limit for said parameter;

means coupled to said scaler circuit and means for selecting and displaying at least one parameter value; and fault circuit means coupled to said correlating means and to said selecting and displaying means and responsive to said event occurred signal for overriding a parameter selected for display in the event a different parameter reaches its associated stored limit indicating a system fault by displaying the fault parameter.

2. The system as defined in claim 1 wherein said sequencing means provides repeated sequence commands defining first and second successive scan intervals and wherein said storage means includes stored warning and alarm parameter limits which are correlated with data from said sensors during said first and second scan periods, respectively, and wherein said fault circuit provides a different signal to said display means for alarm conditions than for warning conditions to indicate the severity of the system fault.

3. The system as defined in claim 2 wherein said correlating means includes an up-down counter wherein the stored parameter limits for a sequence are loaded into said counter during one portion of said sequence and the counter is decremented by the scaled data during a subsequent portion of each sequence to provide said event occurred signal if said counter is decremented to zero indicating the stored parameter limit is reached by the parameter data.

4. The system as defined in claim 3 wherein said selecting and displaying means includes a plurality of operator-actuated switches each associated with a parameter to be monitored.

5. The system as defined in claim 4 wherein said switches include first and second illuminating lamps of different colors and wherein said fault circuit means actuates one of said first lamps associated with a fault parameter when said fault parameter reaches a warning limit and one of said second lamps associated with said fault parameter when said fault parameter reaches an alarm limit.

6. The system as defined in claim 5 and further including audible alarm means coupled to said fault circuit means for providing a momentary audible alarm when a parameter reaches a warning level and a continuous audible alarm when a parameter reaches an alarm level.

7. The system as defined in claim 6 and further including a vehicle engine shutdown circuit coupled to said fault circuit means and to the engine fuel system for terminating engine operation if preselected parameters reach an alarm level.

8. The system as defined in claim 1 wherein said storing means comprises a PROM programmed with parameter limits and coupled to said sequencer to be addressed by signals therefrom to sequentially supply parameter limits to said correlating means.

9. The system as defined in claim 1 including a no data detector coupled to said scaler circuit means and to said fault circuit means to provide an alarm generating signal to said fault circuit means in the event no data pulses are received during a predetermined portion of any sequence.

10. A digital vehicle monitoring system comprising:

circuit means for sequentially scanning and receiving data from a plurality of vehicle parameter sensors and providing output data pulses during each data sequence wherein the number of pulses during each sequence is representative of the parameter value detected by a sensor associated with said sequence and wherein said circuit means provides an equivalent number of pulses for the full scale range of data for each sensor associated with each sequence;

display means for providing a digital display of the detected parameter value for a preselected parameter; and a digital scaler circuit coupled between said circuit means and said display means for frequency dividing said sequences of pulses from said circuit means in a predetermined manner for providing scaled data to said display means wherein a single display can be utilized by said display means to selectively display different parameters with a wide range of displayed values.

11. The system as defined in claim 10 and further including programming means coupled to said circuit means and to said digital scaler circuit for controlling said scaler circuit during each data sequence to divide the pulses of said sequence by a predetermined programmed number for desired scaling of data for each sequence.

12. A digital vehicle monitoring system comprising:

circuit means for sequentially scanning digital data from oil pressure and engine rpm sensors and providing data signals representative of the sensed parameter;

means coupled to said circuit means for correlating said data signals and for providing an output warning signal representative of a predetermined relative magnitude of the detected parameter values indicative of a vehicle fault wherein said correlating means includes frequency dividing means coupled to said circuit means for dividing data representative of the engine rpm by a selected scaling factor and applying the resultant data to an up-down counter, and wherein said data representative of the oil pressure is subsequently applied to said up-down counter to decrement said counter wherein said counter generates said warning signal when decremented to zero; and indicator means coupled to said correlating means for providing a signal to the vehicle operator in response to said output warning signal.

13. The system as defined in claim 12 including storage means coupled to said circuit means and said up-down counter and programmed to apply a control signal to said counter upon receipt of a command signal from said circuit means to actuate said up-down counter to divide data applied thereto by a programmed scaling factor during a sequence.

14. A vehicle monitoring system for use with a plurality of vehicle parameter sensors comprising:

sampling means for sequentially sampling data from a plurality of vehicle parameter sensors;

signal processing means coupled to said sampling means and including programmable means for storing selected vehicle parameter limits therein and for sequentially correlating data from said sampling means with stored data limits and providing a predetermined output signal in the event the sampled data reaches an associated stored limit;

operator-actuated circuit means coupled to said signal processing means for selecting data from a vehicle parameter sensor for display;

display means coupled to said signal processing means for displaying data selected by said operator-actuated circuit means; and fault circuit means coupled to said signal processing means and to said display means and responsive to a predetermined output signal from said signal processing means for overriding an operator-selected data display in the event a vehicle parameter reaches an associated stored limit and for actuating said display means to display data of the parameter which has reached the stored limit.

15. The system as defined in claim 14 wherein said sampling means includes a clock pulse generator and a sequencer circuit coupled to said clock pulse generator to develop a series of sequence commands defining a data sequence for each parameter sensor and for defining first and second scan intervals, each interval including the data sequences.

16. A vehicle monitoring system comprising:

means for sequentially sampling data from a plurality of vehicle parameter sensors wherein said sampling means includes a clock pulse generator and a sequencer circuit coupled to said clock pulse generator to develop a series of sequence commands defining a data sequence for each parameter sensor and for defining first and second scan intervals, each interval including the data sequences;

signal processing means coupled to said scanning means and including means for storing selected vehicle parameter limits therein and for sequentially correlating data from said sampling means with stored data limits and providing a predetermined output signal in the event the sampled data reaches an associated stored limit wherein said storing means of signal processing means comprises a read-only memory programmed with data limits for each data sequence for each scan interval;

means coupled to said signal processing means for displaying data from an operator-selected parameter sensor; and fault circuit means coupled to said signal processing means and to said display means for overriding operator-selected data display in the event a vehicle parameter reaches an associated stored limit and for actuating said display means to display data of the parameter which has reached the stored limit.

17. The system as defined in claim 16 wherein said signal processing means further includes an up-down counter and wherein the stored data limits for a sequence are loaded into said counter during one portion of a data sequence and the counter is decremented by the sampled data during a subsequent portion of each sequence to develop said predetermined output signal if said counter is decremented to zero indicating the stored data limit is reached by the sampled data.

18. The system as defined in claim 17 wherein said signal processing means includes a plurality of operator-actuated switches each associated with a parameter to be monitored and actuatable to apply sampled data associated with the switch to said display means.

19. The system as defined in claim 18 wherein said switches include first and second illuminating lamps of different colors and wherein said fault circuit means actuates one of said first lamps associated with a fault parameter when said fault parameter reaches a limit during said first scan interval and one of said second lamps associated with said fault parameter when said fault parameter reaches a limit during said second scan interval.

20. The system as defined in claim 19 and further including audible alarm means coupled to said fault circuit means for providing a momentary audible alarm when a parameter reaches a first scan interval limit and a continuous audible alarm when a parameter reaches a second scan interval limit.

21. The system as defined in claim 20 and further including a vehicle engine shutdown circuit coupled to said fault circuit means and to the engine fuel system for terminating engine operation if preselected parameters reach a second scan interval limit.

22. The system as defined in claim 21 wherein said read-only memory comprises a PROM programmed with parameter limits and coupled to said sequencer circuit to be addressed by signals therefrom to sequentially supply data limits to said up-down counter.

23. The system as defined in claim 22 and further including a no data detector coupled to said circuit means and to said fault circuit means to apply an alarm generating signal to said fault circuit means in the event no data pulses are received during a predetermined segment of any data sequence.

24. The system as defined in claim 23 wherein said shutdown circuit includes delay means for delaying the vehicle engine shutdown for a predetermined period when preselected sampled data reaches a limit of said second scan interval.

* * * * *